US005321964A

United States Patent [19]

Shimanovski et al.

[11] Patent Number: 5,321,964

[45] Date of Patent: Jun. 21, 1994

[54] EXTERNAL SEAL DEVICE FOR TUBE HYDROFORMING

[75] Inventors: Bruce S. Shimanovski, Southfield; Michael H. Lovell, Leonard; George T. Winterhalter, Sr., Berkley; Sanjay M. Shah, Rochester Hills, all of Mich.

[73] Assignee: General Motors Corporation, Detroit, Mich.

[21] Appl. No.: 71,548

[22] Filed: Jun. 4, 1993

[51] Int. Cl.[5] ..... B21D 39/20; B21D 26/02

[52] U.S. Cl. ..... 72/62; 72/60; 29/421.1

[58] Field of Search ..... 72/59, 60, 61, 62, 58; 29/421.1

[56] References Cited

U.S. PATENT DOCUMENTS

| | | | |
|---|---|---|---|
| 3,040,684 | 6/1962 | Hillgren | 72/58 |
| 3,487,668 | 1/1970 | Fuchs, Jr. | 72/58 |
| 4,289,007 | 9/1981 | Kraft | 72/58 |
| 5,233,854 | 8/1993 | Bowman et al. | 72/58 |
| 5,233,856 | 8/1993 | Shimanovski et al. | 72/62 |
| 7,881,275 | 8/1993 | Bowman et al. | 72/58 |
| 7,890,189 | 8/1993 | Shimanovski et al. | 72/62 |

*Primary Examiner*—David Jones
*Attorney, Agent, or Firm*—Kevin M. Hinman

[57] ABSTRACT

A seal device for a hydroforming press includes a housing having a bore and a seal carrier slidable within the housing bore. The seal carrier has a bore which fits closely outside of the end of tube to be hydroformed. A V-shaped locator rigidly mounted relative to the housing aligns the end of the tube placed thereon with the carrier bore. A carrier actuator is operable to move the seal carrier between a retracted position away from the end of the tube to an extended position over the end of the tube. A resilient elastomeric annular seal carried by the seal carrier encircles the outer surface of the tube. A seal actuator carried on the seal carrier compresses the seal upon relative movement between the seal actuator and the seal carrier. A stop is engaged by the seal actuator as the seal carrier approaches the extended position so that subsequent further movement of the seal carrier compresses the seal against the tube. The locator and a tube backup fixed to an upper bed of the press encircle the tube when the press is closed, reacting against the tube when it is pressurized. A travel limit block provides a reaction member against which the locator reacts to prevent relative movement between the seal device and the press during forming.

7 Claims, 3 Drawing Sheets

EXTERNAL SEAL DEVICE FOR TUBE HYDROFORMING

TECHNICAL FIELD

This invention relates to a seal device for sealing engagement on the outer surface of a tube in a hydroforming press.

BACKGROUND OF THE INVENTION

It is well known, in the prior art, that a tube may be hydroformed to a desired complex tubular shape. The tube is placed between a pair of dies having cavities which define the desired resultant shape of the tube. The ends of the tube are accessible through the die and a seal is connected to the ends of the tube so that pressurized fluid injected into the tube forces the tube to expand and conform to the shape defined by the die cavity. It is also known to mount the dies in a press so that a lower die is stationary on the lower bed of the press and the upper die moves up and down with the upper bed of the press to permit loading and unloading of the tubes from the die.

U.S. Pat. No. 5,233,054, assigned to the assignee of this invention, provides improvements in the press apparatus and in the mounting of a seal unit or seal device on the press. U.S. Pat. No. 5,233,856, assigned to the assignee of this invention, provides an improved seal device for sealing engagement on the outer surface of the tube end in a hydroforming process.

U.S. patent application Ser. No. 08/071,411, filed Jun. 4, 1993, assigned to the assignee of this invention, entitled "External Seal Device for Hydroforming" also discloses a similar seal device having an actuator with a removable end facilitating seal replacement.

The present invention provides a new and improved seal device having locator means for aligning the tube end with the seal device.

SUMMARY OF THE INVENTION

A seal device sealingly engages on an outer surface of an end of a tube to be hydroformed within a die cavity formed between a pair of dies. The seal device includes a seal carrier having an opening adapted for close fitting installation over the end of the tube. A carrier actuator is operable to move the seal carrier between a retracted position withdrawn away from the end of the tube and an extended position in which the seal carrier is installed over the end of the tube.

A V-shaped locator is linked by mounting means to the seal carrier and has surfaces aligning the end of the tube placed thereon with the opening of the seal carrier. A resilient elastomeric annular seal is carried by the seal carrier within the opening thereof and encircles the outer surface of the tube. A seal actuator is slidably carried on the seal carrier and is adapted to compress the seal upon relative movement between the seal actuator and the seal carrier so that the seal is forced radially inward to sealingly engage the outer surface of the tube. A stop element is engaged by the seal actuator as the seal carrier approaches the extended position so that the seal actuator is stopped against further movement and further movement of the seal carrier to the extended position then compresses the seal about the outer surface of the tube.

DESCRIPTION OF THE PREFERRED EMBODIMENT

Figure 1:
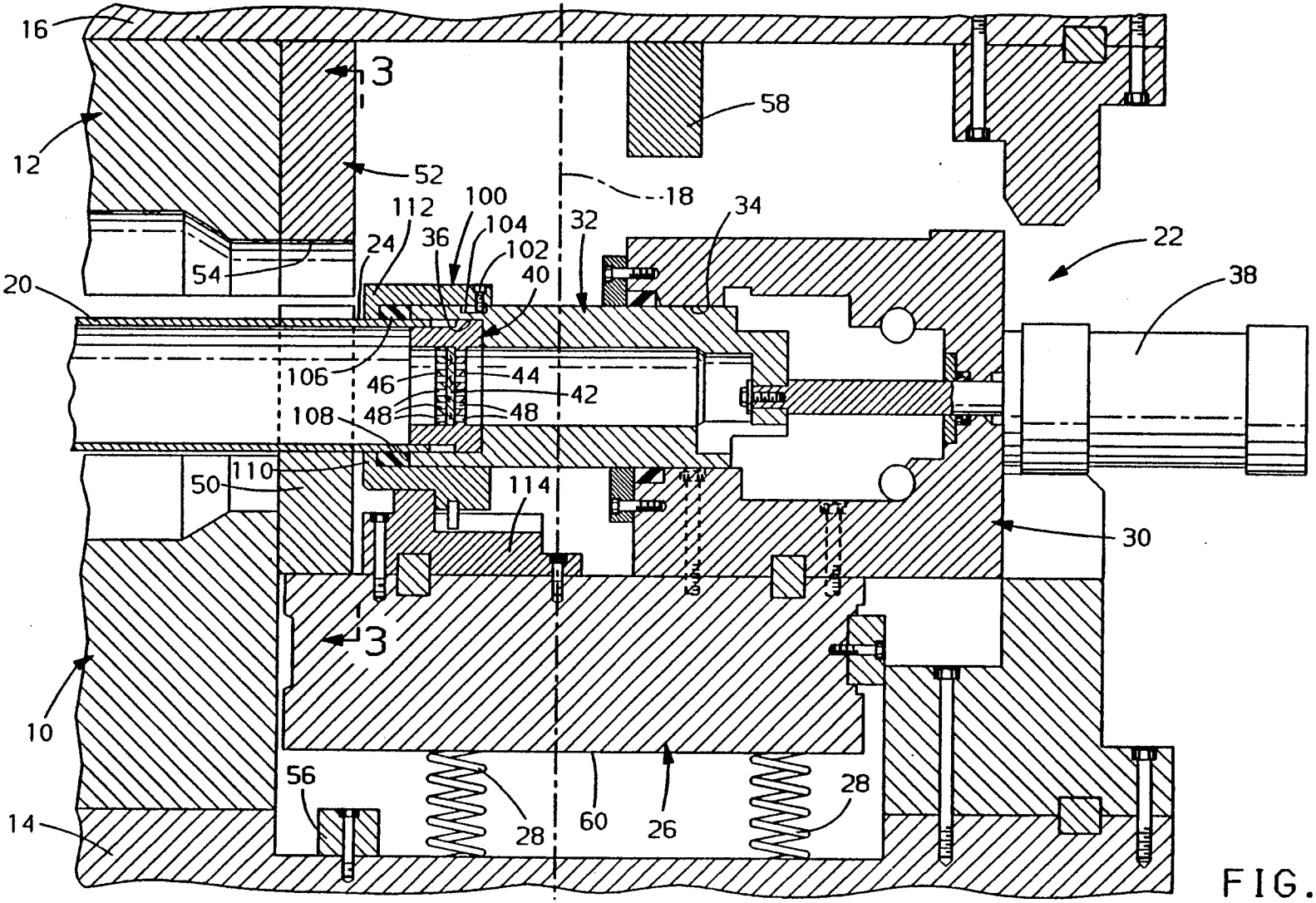
FIG. 1 is a sectional side view of the seal device disposed over the end of the tube with associated press elements in an open position.

U.S. Pat. No. 5,233,854, filed May 29, 1992, assigned to the assignee of the present invention is hereby incorporated by reference.

A press has a first or lower die 10 and a second or upper die 12 mounted to corresponding lower and upper press beds 14 and 16. The press is operable to move the second die 12 along a first axis 18 between an open position shown in FIG. 1 and a closed position shown in FIG. 2. With the second die 12 in the open position, a tube 20 to be hydroformed is held between the first and second dies 10, 12 by a robot or other suitable mechanism. A seal unit or seal device 22, is provided for sealing engagement on an outer surface 24 of an end of the tube 20 and for communicating pressure fluid into the tube 20.

An elevator 26 is suspended above the lower press bed 14 by springs 28 between the elevator 26 and the press bed 14.

A housing 30 of the seal device 22 is rigidly mounted to the elevator 26. A seal carrier 32 is slidably disposed within a cylindrical bore 34 in the housing 30. The seal carrier 32 has a carrier bore 36 adapted to closely fit over the end of the tube 20.

Figure 2:
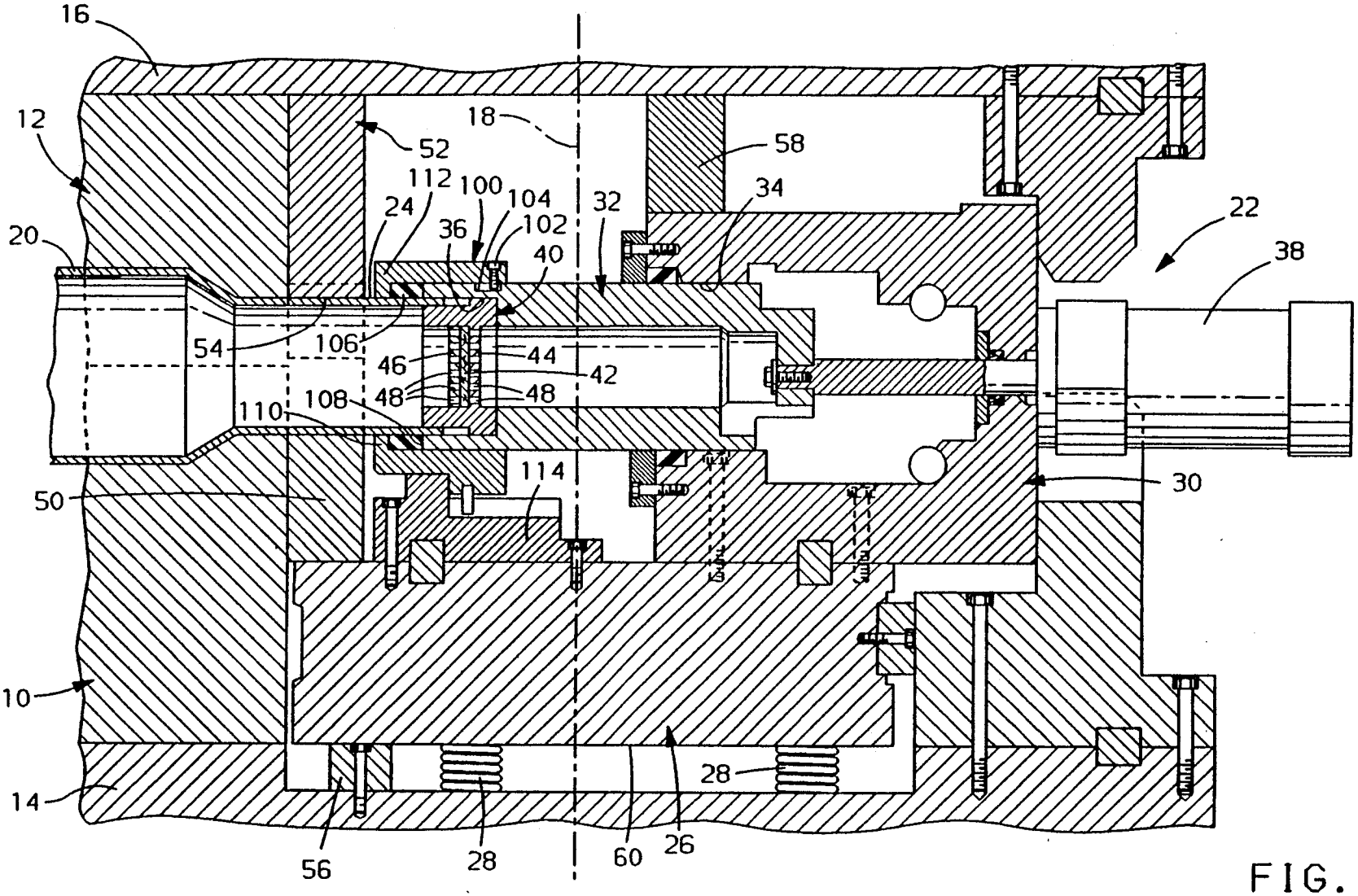
FIG. 2 is a sectional side view of the seal device with the associated press elements in the closed position.

A carrier actuator 38, such as might be provided by a hydraulic cylinder, operably moves the seal carrier 32 between a retracted position (not shown) withdrawn away from the end of the tube 20 and an extended position, as in FIG. 1 and FIG. 2, in which the seal carrier 32 is installed over the end of the tube 20.

A seal actuator 100 is slidably carried on the seal 32 and is limited in available axial travel relative to the seal carrier 32 by a stop bolt 102 projecting radially inward from the seal actuator and slidably received in a slot 104 in the seal carrier. An annular, resilient elastomeric seal 106 is captured between a distal end 108 of the seal carrier and a radially inward directed annular lip 110 at outboard end 112 of the seal actuator 100. The seal actuator 100 engages a stop element 114 rigidly mounted on the elevator 26 before the seal carrier 32 achieves its extended position so that further movement of the seal carrier to its extended position compresses the seal 106 inwardly to sealingly engage the outer surface of the tube 20.

The seal carrier 32 has an annular tube support 40 mounted within the carrier bore 36 to extend inside the tube 20 when the seal carrier 32 is extended.

A filter comprising a sieve element 42 disposed between two reinforcing plates 44, 46 is optionally mounted within the annular tube support 40. The plates 44, 46 each have a plurality of apertures 48 in alignment with the apertures 48 in the other plate.

Figure 3:
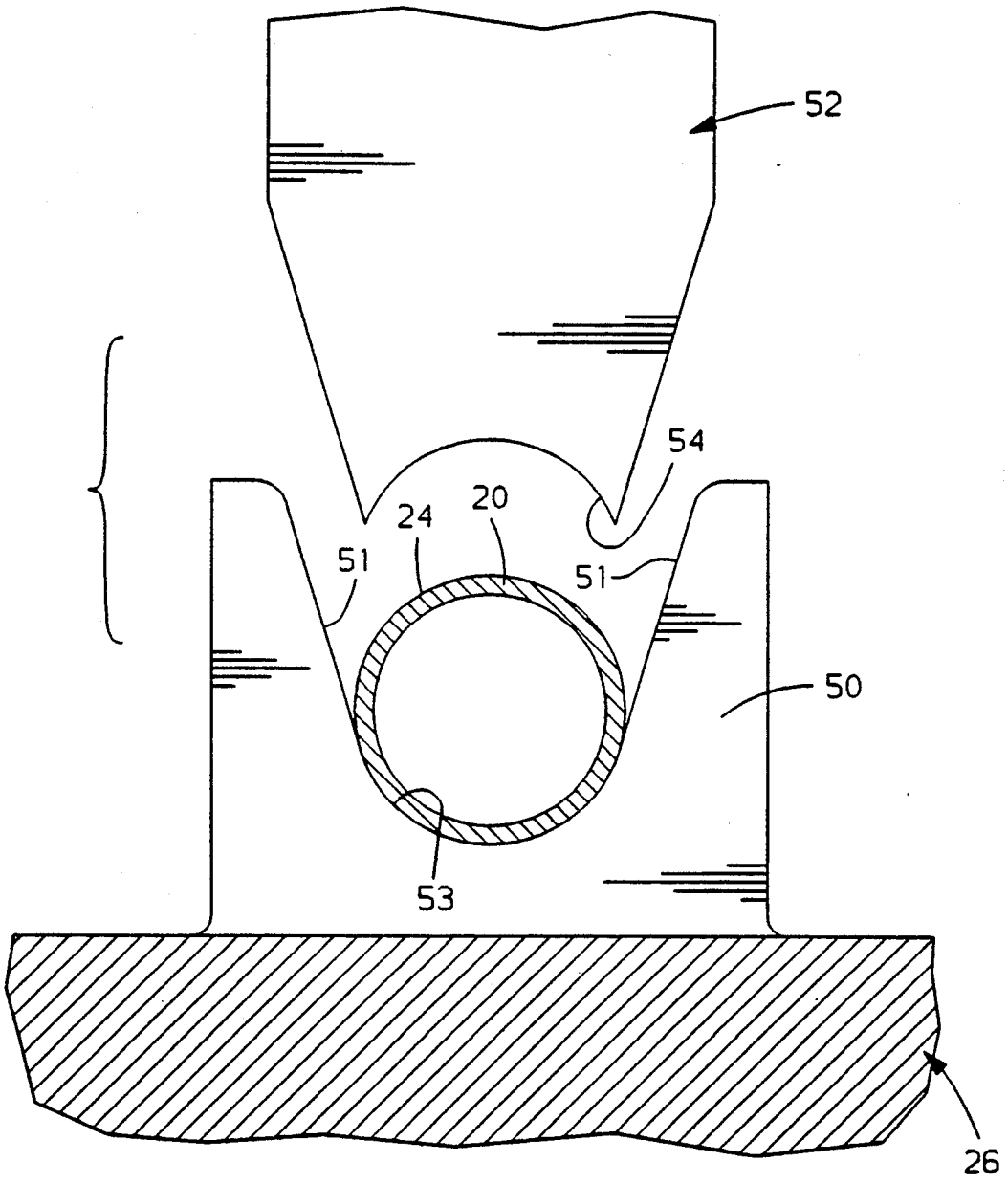
FIG. 3 is an end view of the tube locator with a tube resting thereon and the tube backup disposed above them, taken along lines 3—3 of FIG. 1.

A V-shaped locator 50, best seen in FIG. 3, is rigidly mounted to the elevator 26 between the housing 30 and the dies 10, 12. The V-shaped locator 50 has surfaces 51 which align the end of the tube 20 placed thereon with the carrier bore 36. The locator 50 is open toward the second die 12. The V-shaped locator 50 also has a rounded bottom 53 complementary to the tube 20.

A tube backup 52, best seen in FIG. 3, is fixed relative to the second die 12 and has a concave surface 54 complementary to the tube 20 aligned with and facing the open V-shaped locator 50.

A travel limit block 56, shown in FIG. 1 and FIG. 2, is fixed relative to the first die 10, underneath the elevator 26 with the springs 28 and generally in line with the locator 50.

The seal device 22 operates as follows. The robot loading the tube 20 into the press lowers the end of the tube 20 onto the V-shaped locator 50. Tangential contact between the tube 20 and the V-shaped locator 50 positions the end of the tube 20 with respect to the carrier bore 36.

The carrier actuator 38 moves the seal carrier 32 over the end of the tube 20. The seal device 22 sealingly engages an outer surface 24 of the tube 20, as shown in FIG. 1 and FIG. 2.

The second die 12 moves from the open position downward toward the closed position. A pusher block 58, moving with the second die 12, engages the housing 30, so that with continued movement of the second die 12 to the closed position the seal device 22, elevator 26 and the V-shaped locator 50 will be moved downward as a unit with the second die 12 as the springs 28 permit. This continues until the second die 12 reaches the closed position. With the second die 12 in the closed position, the V-shaped locator 50 and the tube backup 52 encircle the tube 20 therebetween. This puts an underside 60 of the elevator 26 very close to or in contact with the travel limit block 56.

The tube 20 is filled with hydraulic fluid. Fluid entering the tube 20 passes through the filter in the annular tube support 40. When the hydraulic fluid in the tube 20 is pressurized, the tube 20 reacts against the encircling tube backup 52 and V-shaped locator 50. The tube backup 52 directs its portion of the reaction into the upper bed 16 of the press. The V-shaped locator 50 directs its portion of the reaction into the elevator 26, which in turn reacts principally against the travel limit block 56, and ultimately against the lower bed 14 of the press. The travel limit block 56 prevents further spring deflection, thereby maintaining the position of the elevator 26 and the seal device 22 during high pressure forming.

After the tube 20 has been hydroformed, the fluid in the tube 20 is drained off through the seal carrier 32, passing through the filter which protects fluid controls from debris suspended in the returning fluid.

The improved positioning provided by the V-shaped locator 50 offers a cost benefit which can be realized by permitting more generous tolerances for any required bending of tubes to be hydroformed and for the positioning of the tube 20 between the dies 10, 12 by the robot.

The embodiments of the invention in which an exclusive property or privilege is claimed are defined as follows:

1. In an apparatus for hydroforming a tube between a pair of dies, a seal device for sealing engagement on an outer surface of an end of the tube and for communicating pressure fluid into the tube comprising:

a seal carrier having means thereon defining an opening adapted for installation over the end of the tube;

a locator means disposed between the pair of dies and the seal carrier operative to align the end of the tube with the opening in the seal carrier;

a carrier actuator separated from the dies by the seal carrier operable to move the seal carrier between a retracted position and an extended position nearer to the dies than the retracted position in which the opening in the seal carrier is disposed over the end of the tube between the dies;

a seal actuator mounted on the seal carrier for movement relative thereto;

a resilient elastomeric annular seal carried by the seal carrier within the seal actuator and adapted to encircle the outer surface of the tube, the seal being compressed upon relative movement between the seal actuator and the seal carrier so that the seal is compressed inwardly to sealingly engage the outer surface of the tube; and a stop element engaged by the seal actuator as the seal carrier approaches the extended position so that the seal actuator is stopped against further movement and further movement of the seal carrier to the extended position then compresses the annular seal about the outer surface of the tube.

2. A seal device as claimed in claim 1 further characterized by the locator means comprising:

a V-shaped locator linked by mounting means to the seal carrier and having means defining surfaces aligning the end of the tube placed thereon with the opening of the seal carrier.

3. In an apparatus for hydroforming a tube between a pair of dies, a seal device for sealing engagement on an outer surface of an end of the tube and for communicating pressure fluid into the tube comprising:

a housing;

a seal carrier mounted on the housing for movement between a retracted position and an extended position near to the pair of dies than the retracted position and having means thereon defining an opening adapted for installation over the end of the tube in the extended position of the seal carrier;

a locator means disposed between the pair of dies and the housing operative to align the end of the tube with the opening in the seal carrier;

a carrier actuator mounted on the housing operable to move the seal carrier between the retracted position and the extended position;

a seal actuator mounted on the seal carrier for movement relative thereto;

a resilient elastomeric annular seal carried by the seal carrier within the seal actuator and adapted to encircle the outer surface of the tube, the seal being compressed upon relative movement between the seal actuator and the seal carrier so that the seal is compressed inwardly to sealingly engage the outer surface of the tube; and a stop element engaged by the seal actuator as the seal carrier approaches the extended position so that the seal actuator is stopped against further movement and further movement of the seal carrier to the extended position then compresses the annular seal about the outer surface of the tube.

4. A seal device as claimed in claim 3 further characterized by the locator means comprising:

a V-shaped locator rigidly connected to the housing having means defining surfaces aligning the end of the tube placed thereon with the opening of the seal carrier.

5. In an apparatus for hydroforming a tube between a first die and a second die mounted in a press operable to move the second die along a first axis between an open position and a closed position, a seal device for sealing engagement on an outer surface of an end of the tube and for communicating pressure fluid into the tube comprising:

a housing having a cylindrical bore;

a cylindrical seal carrier slidable within the housing bore between a retracted position and an extended position nearer to the first and the second dies than the retracted position and having a carrier bore adapted for close fitting installation over the end of the tube in the extended position of the seal carrier;

a carrier actuator mounted on the housing operable to move the seal carrier between the retracted position and the extended position;

a locator means between the housing and the first and the second dies operative to align the end of the tube with the carrier bore;

a seal actuator mounted on the seal carrier for sliding movement relative thereto;

a resilient elastomeric annular seal carried by the seal carrier within the seal actuator and encircling the outer surface of the tube so that the annular seal is compressed and forced radially inward to sealingly engage the outer surface of the tube upon relative movement between the seal actuator and the seal carrier;

a stop element engaged by the seal actuator as the seal carrier approaches the extended position so that the seal actuator is stopped against further movement and further movement of the seal carrier to the extended position then compresses the annular seal about the outer surface of the tube;

resilient means between the housing and the first die biasing the housing toward the second die parallel with the first axis; and abutment means rigidly fixed relative to the second die contacting the housing as the press moves the second die toward the closed position with continued movement of the second die to the closed position overcoming the resilient means thereby displacing the housing toward the first die.

6. A seal device as claimed in claim 5 further characterized by the locator means comprising:

a V-shaped locator rigidly connected to the housing and having means defining surfaces aligning the end of the tube placed thereon with the carrier bore.

7. A seal device as claimed in claim 6 further comprising:

the V-shaped locator open in the direction of the second die with the opening having a rounded bottom complementary to the tube and being rigidly mounted relative to the housing;

a tube backup fixed relative to the second die having means defining a concave surface complementary to the tube facing the open V-shaped locator with the tube being encircled therebetween when the second die is in the closed position; and a travel limit block fixed relative to the first die limiting movement of the housing away from the second die when the second die is in the closed position.

* * * * *